US005416983A

United States Patent [19]

Moser

[11] Patent Number: 5,416,983

[45] Date of Patent: May 23, 1995

[54] CLOTHES DRYER WITH STATIC REDUCTION

[75] Inventor: Scott A. Moser, Dorchester, Canada

[73] Assignee: Stat-Tech Limited Partnership, Dorchester, Canada

[21] Appl. No.: 209,889

[22] Filed: Mar. 14, 1994

[51] Int. Cl.[6] ..... F26B 3/34

[52] U.S. Cl. ..... 34/250; 34/602; 34/60; 361/212

[58] Field of Search ..... 34/60, 250, 380, 389, 34/595, 597, 602, 603; 361/212

[56] References Cited

U.S. PATENT DOCUMENTS

| | | | |
|---|---|---|---|
| 2,568,068 | 9/1951 | Harpman | 361/222 |
| 3,161,479 | 12/1964 | Biderman | 361/212 |
| 3,991,479 | 11/1976 | Dionne | 34/248 |
| 4,190,874 | 2/1980 | Pasold | 361/212 |
| 4,881,325 | 11/1989 | Jordan et al. | 34/60 |

*Primary Examiner*—Denise L. Gromada
*Attorney, Agent, or Firm*—Mirek A. Waraksa

[57] ABSTRACT

A clothes dryer is adapted to reduce residual static in clothing items. The sidewall of the drum carries conductive tumbling vanes and a conductive projection. The vanes engage clothing items at the periphery of the dram interior. The projection penetrates further into the drum to contact clothing items that tend to locate there when the dryer is very full. The projection curves in the direction of drum rotation to avoid trapping clothing against the drum side wall. The vanes and projection are coupled to the ground terminal of an electrical main to dissipate static charges gathered from the clothing. To enhance electrical coupling to the rotary drum, a copper ring is mounted around the drum and a copper contact plate is supported from the dryer housing and spring-biased to engage the copper ting. Residual static is further reduced with a grounded conductive plate located near the bottom of the dryer opening that accesses the drum. The conductive plate defines an upward arcuate projection centered horizontally relative to the dryer opening and a recess to either side of the projection so that clothing items are spread across its conductive surface as they are dragged through the dryer opening.

10 Claims, 3 Drawing Sheets

CLOTHES DRYER WITH STATIC REDUCTION

FIELD OF THE INVENTION

The invention relates to clothes dryers adapted to dissipate static charges that develop in clothing items as they are tumbled and subjected to heat.

BACKGROUND OF THE INVENTION

My Canadian Patent No. 1,310,824 describes a dryer in which electrically conductive caps cover the tumbling vanes extending from the rotary drum associated with the dryer. The caps are electrically coupled through the core of the drum to a conductive band encircling the exterior of the drum. A spring-biased carbon brush is supported from the dryer housing and contacts the band. The carbon brush is connected through a conventional electrical plug to the ground terminal of an electrical main. The caps contact clothing items as they are tumbled, and static charges that develop in the items are dissipated to the electrical main.

The dryer is effective in reducing static charges. However, considerable residual charge can remain in clothing items depending on the particular fabrics involved and the extent to which the dryer is filled. The object of the present invention is to provide features for driers that further reduce static charges accumulating in clothing items.

BRIEF SUMMARY OF THE INVENTION

The invention has application to a dryer which has a housing, a drum located within the housing, and means supporting the drum for rotation about a horizontal rotational axis. The drum will typically have a horizontal cylindrical side wall centered about the rotational axis, a blind end wall and an opposing open end wall. The drum has a tumbling vane that extends inwardly from the drum side wall to cause clothing items to tumble with rotation of the drum. A vertical opening in the housing accesses the open end wall of the drum for insertion and removal of clothing items to and from the drum.

In such a context, the invention provides various apparatus for reducing static in the clothing items dried within the dryer. The apparatus includes an electrically conductive band located about the drum and rotating with the drum about the drum's rotational axis. Means are provided to couple the conductive band to a ground terminal of an electrical main. A projection is located within the drum. It has a base portion fixed to the drum side wall and a free distal end portion that has an electrically conductive outer surface. The vane extends to within a first radial distance of the rotational axis of the drum but the distal end portion extends to within a second, significantly smaller radial distance of the rotational axis. The distal end portion thus penetrates further toward the center of the drum sidewall than the vane and gathers static charges from clothing items that locate in the center region of the drum. The conductive surface is electrically coupled to the conductive band to allow the static charges to be dissipated to the ground terminal of the electrical main.

To avoid interfering excessively with tumbling action, the projection is elongate and spaced from both end walls of the dryer drum. Preferably, the projection is located in a plane perpendicular to the drum's rotation axis and substantially midway between the end walls. The projection may also curve in the predetermined angular direction in which the drum is normally rotated. This reduces the likelihood that clothing items will become trapped between projection and the drum side wall. The projection preferably has a substantially uniform circular cross-section between its base and distal end portions and the distal end portion is substantially hemispherical in shape, to further reduce interference with tumbling action.

In practice, the vane or vanes associated with the dryer drum will also present conductive surfaces coupled to the conductive band to dissipate static charges, as in my prior dryer. Such vanes generally extend fully between the open and blind end walls of a drum and can consequently only extend a limited distance into the dryer drum before causing significant interference with tumbling action. The conductive vane or vanes are effective in reducing static charges in clothing items that locate at a radially peripheral region of the drum but the projection significantly reduce static charges when a dryer is operated at substantially full capacity and certain clothing items tend to remain in a central region of the drum.

It has also been discovered in experiments that the nature of the electrical contact made with the rotating drum can significantly affect dissipation of static charges. Electrical contact with a rotating element is commonly made with a carbon brush. That appears adequate for conventional purposes. However, for purposes of dissipating static in clothing items within a dryer, electrical contact is enhanced considerably by mounting a copper ring about the dryer drum, using an electrical contact formed of copper to engage the ring, and using biasing means such as a spring to urge the copper contact into engagement with the rotating copper ting. In experiments involving a rotary dryer drum whose vanes were fitted with conductive stainless steel caps, the copper-to-copper contact was found to reduce residual by 7 to 12 per cent. Qualitatively, the result is a very noticeable reduction in clinging between dried fabric items removed from the drier.

Residual static may be further reduced with a member attached to the dryer housing and defining an electrically conductive surface within the vertical opening of the housing through which clothing items are removed. The electrically conductive surface is positioned proximate the bottom of the vertical opening to engage the clothing items as the they are dragged from the drum. The electrically conductive surface of the member is also coupled the ground terminal of the electrical main for purposes of static dissipation. In preferred form, the electrically conductive surface is shaped to define an arcuate upward projection substantially centered horizontally relative to the vertical opening and to define a recess to either side of the arcuate upwardly projection thereby to spread clothing items horizontally over the electrically conductive surface as they are dragged from the drum. Otherwise, clothing items may have only limited contact with the charge-dissipating surface.

Various aspects of the invention will be apparent below from a description of a preferred embodiment and will be more specifically defined in the appended claims.

BRIEF DESCRIPTION OF THE DRAWINGS

The invention will be better understood with reference to drawings in which.

DESCRIPTION OF PREFERRED EMBODIMENT

Figure 1:
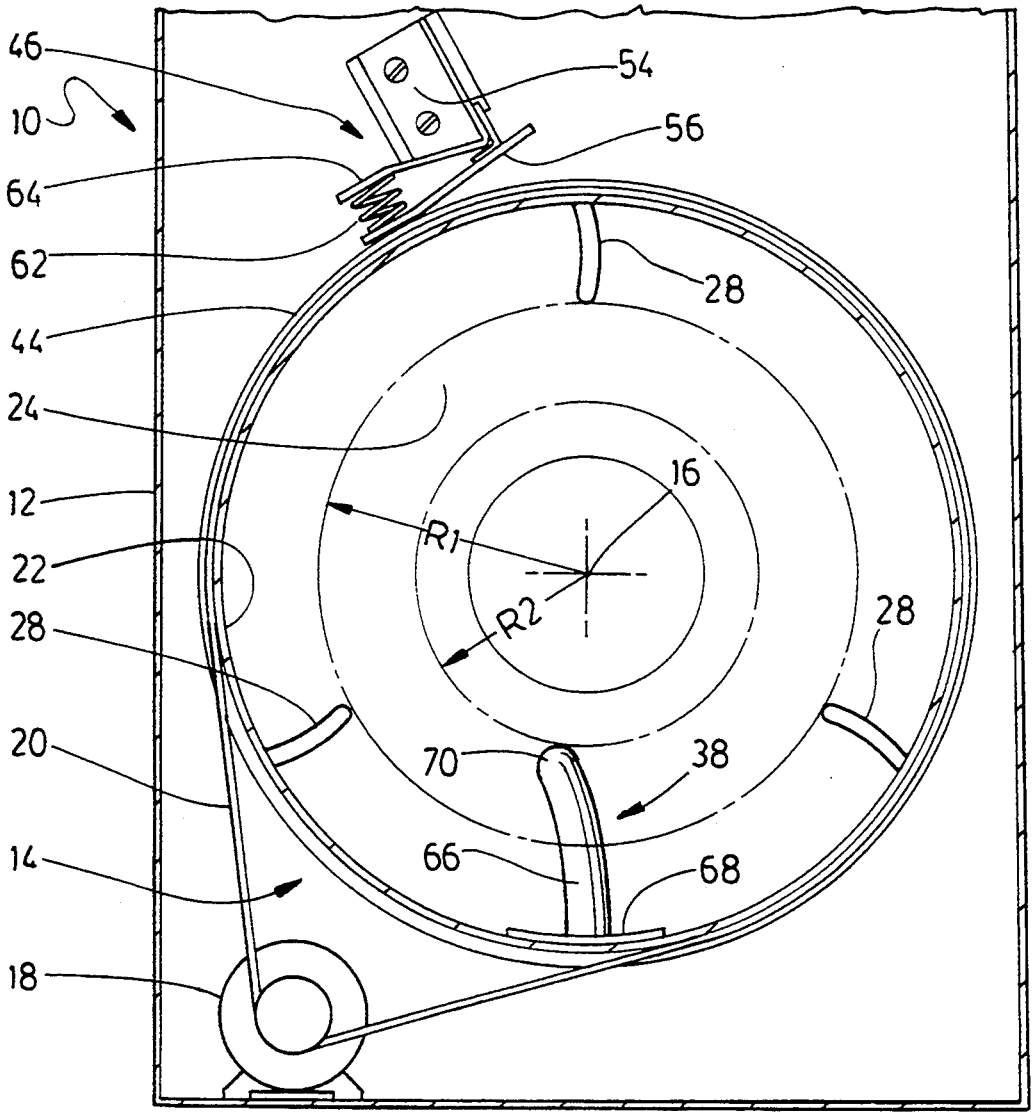
FIG. 1 is a fragmented cross-sectional view in a vertical plane of a clothes dryer.
Figure 2:
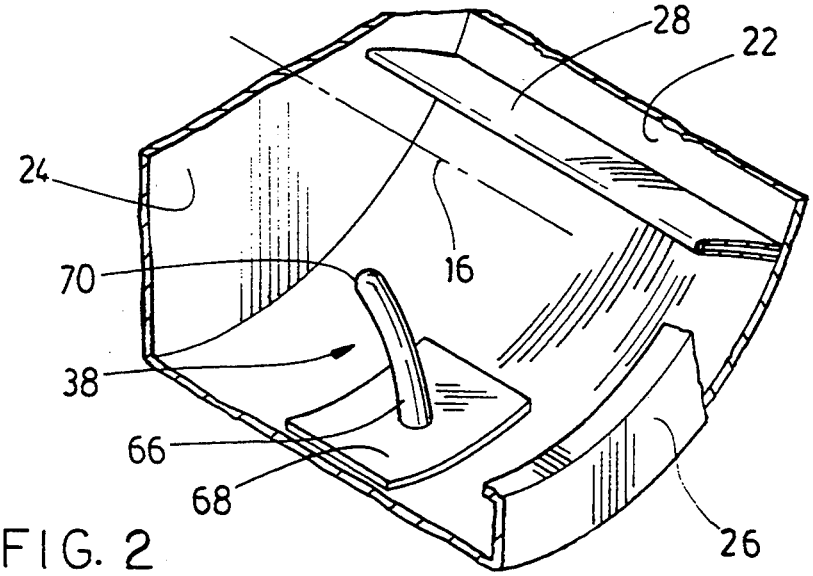
FIG. 2 is a fragmented perspective view further detailing a static-dissipating projection mounted within a rotary drum of the dryer; and, FIG. 3 is a fragmented elevational view of a front panel of the dryer with the dryer door open to show a static-dissipating plate in the housing opening that accesses the dryer drum.
Figure 3:
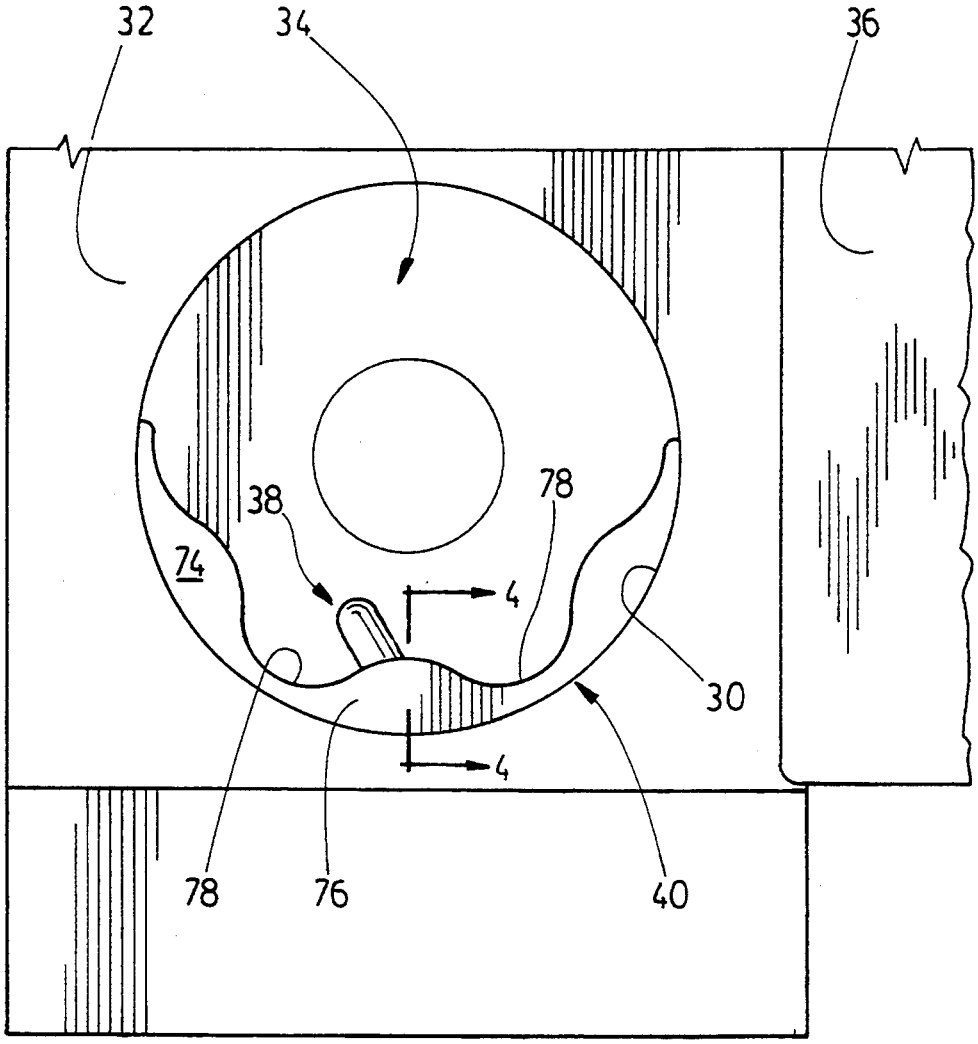

FIG. 1 shows principal components of a clothes dryer 10 embodying various aspects of the present invention. The dryer 10 has a housing 12 which contains a rotary drum 14 supported for rotation about a horizontal rotational axis 16. The dryer 10 has motor 18 which is coupled to the drum 14 with a drive belt 20 and appropriate drum-supporting means such as rollers (not illustrated) to rotate the drum 14 in a counter-clockwise direction about the rotational axis 16. The drum 14 has a cylindrical side wall 22 that is horizontally oriented and centered on the rotational axis 16, a blind end wall 24 (more apparent in FIG. 2), and an opposing open end wall 26 (indicated in FIG. 2). The drum 14 has three identical vanes 28 that extend inwardly from the drum side wall 22 to within a radial distance R1 (indicated in part with a phantom circle) of the rotational axis 16. As apparent from FIGS. 3 and 4, an annular lip 30 is formed in the front panel 32 of the housing 12 and defines a vertical opening 34 that accesses the open end wall 26 of the drum 14 for insertion and removal of clothing items. The opening 34 is normally closed with a hinged door 36. Means for delivering heated air flows to the drum 14 and for exhausting moisture-laden air have not been illustrated, as well as many other features commonly associated with such a dryer. The overall configuration is conventional and thus will not be described further.

Figure 6:
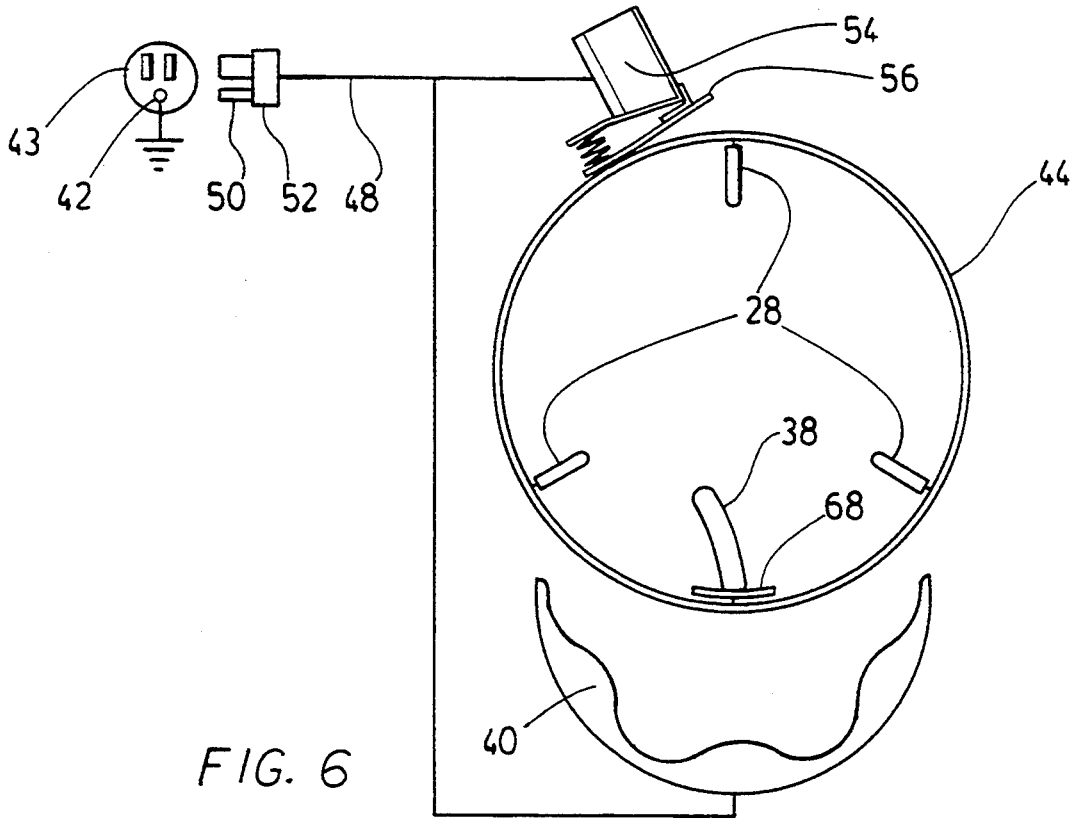

The dryer 10 has various features directed to dissipating static in the clothing items dried within the drum 14. The vanes 28 have electrically conductive stainless steel caps (not illustrated as distinct components of the vanes 28). An electrically conductive projection 38 is also located within the drum 14. As well, a static-dissipating plate 40 (shown in FIGS. 3 and 4) is mounted in the dryer opening 34 to engage clothes as they are dragged from the dryer 10. As will be more apparent in FIG. 6, the static-dissipating components are coupled in operation to the ground terminal 42 of an electrical main 43. The vanes 28 and the projection 38 are coupled through a circular copper ring 44 mounted about the exterior of the drum 14 and a stationary contact assembly 46 that engages the rotating copper ring 44. The contact assembly 46 is ultimately coupled by the power cord 48 of the dryer 10 and the ground prong 50 of the plug 52 to the ground terminal 42 of the electrical main 43. The core of the drum 14 may electrically couple the vanes 28 and the projection 38 to the copper ring 44 substantially as described in my Canadian patent No. 1,310,824 whose teachings are incorporated herein by reference. Alternatively, wiring may be led from the vanes 28 and the projection 38 through the core of the drum 14 to the copper ring 44 as diagrammatically illustrated in FIG. 6.

Figure 5:
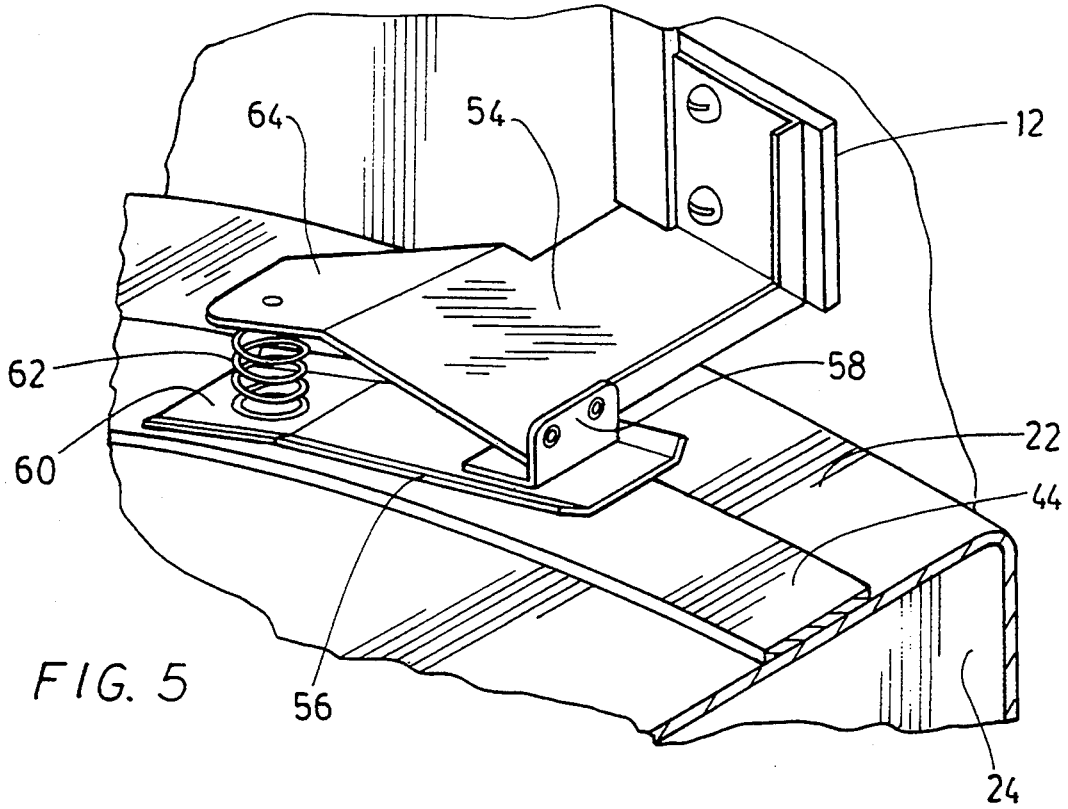
FIG. 5 is a fragmented perspective view of an electrical contact assembly used in the grounding of dryer components rotating with the dryer drum; and, FIG. 6 is a schematic representation of the electrical connections between various components of the dryer.

The contact assembly 46 is shown in greater detail in FIG. 5. It includes a stationary support 54 formed of steel plate that is screwed to the dryer housing 12. A copper contact 56 is hinged to the support 54 for movement toward and away from the ring 44. The hinge 58 is an angled piece of steel plate that is riveted to the support 54 and to the copper contact 56. The contact 56 is formed from sheet copper with lateral edges bent to add structural rigidity and with a lower portion 60 bent to seat substantially tangentially against the copper ring 44. A coil spring 62 is mounted between a tab 64 formed with the support 54 and the lower portion 60 of the copper contact 56 to urge the contact 56 against the copper ring 44. The support 54 is connected to the ground prong 50 of the plug 52 (as diagrammatically shown in FIG. 6). One advantage of the contact assembly 46 is that the copper-to-copper contact significantly enhances dissipation of static through the vanes 28 and the projection 38. Another advantage is that manufacturing costs is significantly lower than conventional brush-type arrangements.

The projection 38 is formed of stainless steel. The constituent material is not only electrical conductive but resistant to corrosion in response to water and residual detergent in laundered clothing. The projection 38 is spaced from both the blind and open end walls 24, 26 and is located substantially in a plane perpendicular to and substantially midway between the end walls 24, 26. The projection 38 has a base portion 66 welded to a stainless steel plate 68. The plate 68 is in turn bolted to the drum side wall 22. The projection 38 has a free distal end portion 70 which is substantially hemispherical in shape. The distal end portion 70 extends inwardly toward the center of the drum 14 to within a radial distance R2 of the rotational axis 16 which is smaller than the radial distance R1 associated with the vanes 28. The projection 38 has a substantially uniform transverse circular cross-section between the base portion 66 and the distal end portion 70. It also curves in counter-clockwise direction. As mentioned above, the projection 38 is configured not to interfere significantly with tumbling action within the drum 14. It penetrates more deeply into clothing items filling the drum 14 and presents a conductive static-dissipating near the center of the drum 14. Its curvature induces clothing items to fall from between the projection 38 and the drum side wall 22 whenever the projection 38 locates at the top of the drum 14 as the drum 14 rotates.

Figure 4:
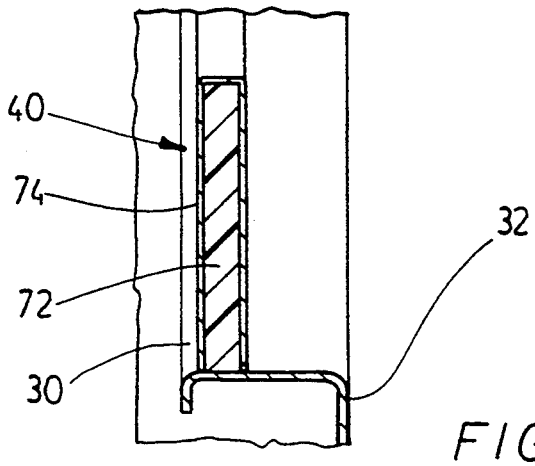
FIG. 4 is a view along lines 4—4 of FIG. 3 indicating further detailing the construction and mounting of the static-dissipating plate.

The static-dissipating plate 40 may have a plastic core 72 with a metalized electrically conductive outer surface 74 as shown in FIG. 4. In this particular embodiment of the invention, the plate 40 is mounted to the lip 30 surrounding the dryer housing 12, at the bottom of the opening 34. It may simply be bolted to the lip 30. The upper edge of the conductive surface 74 is formed with undulations. In particular, it is shaped to define an arcuate upward projection 76 that is substantially centered horizontally relative to the vertical opening 34. It also defines a recess 78 to either side of the arcuate projection 76. When clothing items are dragged from the drum 14, centrally across the static-dissipating plate 40, the arcuate projection 76 tends to spread the items across the conductive surface 74. As explained above, this increases dissipation of residual static. The arrangement shown is suitable for retrofitting an existing dryer. The static-dissipating member may, however, be configured to replace the lip 30 defining the dryer opening 34.

It will be appreciated that a particular embodiment of the invention has been described and that modification may be made therein without departing from the spirit of the invention or necessarily departing from the scope of the appended claims.

I claim:

1. In a clothes dryer comprising a housing, a rotary drum located within the housing and means for rotating the drum in a predetermined angular direction about a horizontal rotational axis, the drum comprising a horizontal cylindrical side wall centered on the rotational axis, a blind end wall and an opposing open end wall, the drum comprising a tumbling vane extending inwardly from the drum side wall to within a first radial distance of the rotational axis, and the housing comprising a vertical opening that accesses the open end wall of the drum for insertion and removal of clothing items to and from the drum, apparatus for reducing static in the clothing items dried within the dryer, the apparatus comprising:

an electrically conductive band located on the drum and rotating about the rotational axis with the drum;

electrical coupling means for electrically coupling the conductive band to a ground terminal of an electrical main;

an elongate projection located within the drum, the projection being spaced horizontally from the open end wall and from the blind end wall, the projection comprising a base portion fixed to the drum side wall and a free distal end portion extending to within a second radial distance of the rotational axis, the second radial distance being significantly smaller than the first radial distance, the projection curving in the predetermined angular direction, the distal end portion of the projection comprising an outer electrically conductive surface; and, means electrically coupling the conductive surface of the projection to the band.

2. The clothes dryer of claim 1 in which the projection has a substantially uniform circular cross-section between the base portion and the distal end portion and in which the distal end portion is substantially hemispherical in shape.

3. The clothes dryer of claim 1 in which the apparatus further comprises:

a member attached to the dryer housing and defining an electrically conductive surface at the vertical opening of the housing, the conductive surface of the member being positioned to engage the clothing items as the clothing items are dragged from the drum at the bottom of the vertical opening; and, means for coupling the conductive surface of the member to the ground terminal of the electrical main.

4. The clothes dryer of claim 3 in which the conductive surface of the member is shaped to define an arcuate upward projection substantially centered horizontally relative to the vertical opening in the housing and to define a recess to either side of the arcuate upward projection thereby to spread clothing items horizontally over the conductive surface of the member as the clothing items are dragged over the member during removal from the dryer drum.

5. The clothes dryer of claim 1 in which the conductive band is a copper ring and in which the electrical coupling means comprise:

a support structure fixed to the housing;

an electrical contact formed of copper; and, mounting means mounting the copper contact to the support structure for displacement toward the copper ring; and, biasing means urging the copper contact against the copper ring.

6. In a clothes dryer comprising a housing, a rotary drum located within the housing, and means for rotating the drum in a predetermined angular direction about a horizontal rotational axis, the dram comprising a horizontal cylindrical side wall centered on the rotational axis, a blind end wall and an opposing open end wall, the housing comprising a vertical opening that accesses the open end wall of the drum for insertion and removal of clothing items to and from the drum, apparatus for reducing static in the clothing items dried within the dryer, the apparatus comprising:

an electrically conductive band located on the drum and rotating with the drum around the rotational axis;

electrical coupling means for electrically coupling the conductive band to a ground terminal of an electrical main;

a tumbling vane located within the drum, the vane being attached to the drum side wall and extending radially inwardly from the drum side wall to within a first radial distance of the rotational axis, the vane comprising an outer electrically conductive surface;

an elongate projection located within the drum, the projection being spaced horizontally from the open end wall and from the blind end wall, the projection comprising a base portion fixed to the drum side wall and a free distal end portion extending to within a second radial distance of the rotational axis, the second radial distance being significantly smaller than the first radial distance, the distal end portion comprising an outer electrically conductive surface; and, means electrically coupling the conductive surface of the vane and the conductive surface of the projection to the band, whereby, the vane contacts and dissipate static charges in clothing items at a radially peripheral region of the drum and the projection contacts and dissipates static charges in clothing items in a central region of the drum.

7. The clothes dryer of claim 6 in which the projection curves in the predetermined angular direction.

8. The clothes dryer of claim 6 in which the conductive band is a copper ring and in which the electrical coupling means comprise:

a support structure fixed to the housing;

an electrical contact formed of copper; and, hinge means connecting the copper contact to the support structure for pivoting toward the copper ring, the hinge means consisting of an angled metal plate fixed to the support structure and to the copper contact; and, a spring acting between the support structure and the copper contact to urge the copper contact against the ring.

9. The clothes dryer of claim 6 in which the apparatus further comprises:

a member attached to the dryer housing and defining an electrically conductive surface at the vertical opening of the housing, the conductive surface of the member being positioned to engage the clothing items as the clothing items are dragged from the drum at the bottom of the vertical opening; and, means for electrically connecting the conductive surface of the member to a ground terminal of an electrical main.

10. The clothes dryer of claim 9 in which the conductive surface of the member is shaped to define an arcuate upward projection substantially centered horizontally relative to the vertical opening in the housing and to define a recess to either side of the arcuate upward projection thereby to spread clothing items horizontally over the conductive surface of the member as the clothing items are dragged over the member during removal from the dryer drum.

* * * * *